US009869165B2

(12) United States Patent
Hightower et al.

(10) Patent No.: US 9,869,165 B2
(45) Date of Patent: Jan. 16, 2018

(54) PLUNGER LIFT ARRANGEMENT

(71) Applicants: Kevin W. Hightower, Burleson, TX (US); David A. Green, Highlands Ranch, CO (US); Neil W. Longfellow, Boulder, CO (US); Robert E. Bender, Evergreen, CO (US)

(72) Inventors: Kevin W. Hightower, Burleson, TX (US); David A. Green, Highlands Ranch, CO (US); Neil W. Longfellow, Boulder, CO (US); Robert E. Bender, Evergreen, CO (US)

(73) Assignee: Well Master Corp, Golden, CO (US)

( * ) Notice: Subject to any disclaimer, the term of this patent is extended or adjusted under 35 U.S.C. 154(b) by 388 days.

(21) Appl. No.: 14/121,770

(22) Filed: Oct. 15, 2014

(65) Prior Publication Data

US 2016/0108710 A1 Apr. 21, 2016

(51) Int. Cl.
*E21B 43/12* (2006.01)

(52) U.S. Cl.
CPC ..... *E21B 43/121* (2013.01)

(58) Field of Classification Search
CPC .... F04B 47/028; F04B 47/022; E21B 43/121; E21B 43/123; E21B 43/08; E21B 2034/002
See application file for complete search history.

(56) References Cited

U.S. PATENT DOCUMENTS 8,066,496 B2 * 11/2011 Brown ..... E21B 43/127 166/105
8,448,710 B1 * 5/2013 Stephens ..... E21B 43/121 166/105
2005/0241819 A1 * 11/2005 Victor ..... E21B 43/127 166/68

* cited by examiner

*Primary Examiner* — Robert E Fuller
*Assistant Examiner* — David Carroll
(74) *Attorney, Agent, or Firm* — Don Halgren

(57) ABSTRACT

A plunger for extraction of hydrocarbon fluids from a gas well system wherein the plunger is arranged to move upwardly and downwardly in an arrangement of inner tubing within the gas well system. The plunger comprises an elongated housing sleeve having a longitudinally directed bore, an elongated central chamber within the longitudinally directed bore, the central chamber having a plug nestable seat at each end thereof; and a plug displacably arranged within the central chamber so as to seal the bore during travel of the plug in a first direction in the inner tubing, and to permit flow of fluid through the plunger as the plunger travels in a second direction in the inner tubing.

16 Claims, 6 Drawing Sheets

PLUNGER LIFT ARRANGEMENT

BACKGROUND OF THE INVENTION

Field of the Invention

This invention relates to plunger lift arrangements for oil and gas wells, and more particularly to improvements to assist the plunger in lifting fluids to the top of the well, and is a continuation-in-part of Ser. No. 13/999,272 filed on Feb. 4, 2014, which is a continuation-in-part of Ser. No. 13/506,464, filed on Apr. 20, 2012, which is a continuation-in-part application of Ser. No. 13/374,830, filed Jan. 17, 2012 and is a continuation-in-part application of Ser. No. 12/586,736, filed Sep. 25, 2009, now U.S. Pat. No. 8,201,629, issued 19 Jun. 2012, and of Ser. No. 12/460,099, now U.S. Pat. No. 8,162,053, issued 24 Apr. 2012, which is a re-filing of Ser. No. 12/313,279, and is a continuation-in-part application of Ser. No. 11/715,216, now U.S. Pat. No. 7,748,448, issued 6 Jul. 2010 and also of Ser. No. 12/217,756, now U.S. Pat. No. 7,793,728, issued 14 Sep. 2010, which is a continuation of Ser. No. 11/350,367, now U.S. Pat. No. 7,395,865 which was based upon Provisional Patent Application 60/593,914, filed 24 Feb. 2005.

DISCUSSION OF THE ART

During the production of hydrocarbons from oil and gas wells, liquid is produced in the form of water and hydrocarbon condensate. As the formation depletes, the ability of the well to remove liquid under naturally flowing conditions diminishes and residual liquid accumulates in the well bore. This liquid buildup creates a back pressure against the reservoir, further reducing production flow and thus generating a further buildup of liquid. Without intervention this continues until the well stops producing and it expires.

There are many techniques for removing the liquids from wells, included amongst them is an artificial lift plunger lift which is a method that uses a piston, referred to as a plunger, which uses the flow produced by the well to lift liquids from the well by acting as an interface between the driving flow beneath the plunger and the liquids above it. This technique has become popular in wells with sufficient gas to lift a liquid load using the plunger interface as a piston because it requires no external energy source and is therefore very economical. Plunger lift has allowed wells that are not economical to run, to become economical by maintaining steady production and extending the life of the well, allowing more hydrocarbons to be produced from a given well formation.

Conventionally, plunger lift requires the well to be shut by utilizing a valve at the wellhead to stop the flow, to allow the plunger to fall to the bottom of the production string, thereby allowing the well bore to build up pressure anew. When the plunger reaches the bottom of the well and sufficient pressure builds up, the well is opened and the plunger brings up a fresh load of liquid to the wellhead, the plunger functioning as a mechanical interface between the gas flow pushing upwardly from below and a load of liquid above it. Upon arriving at the wellhead that well either can be shut in to immediately restart the cycle, or the plunger may be held in the wellhead while the well continues to flow during what is called "afterflow" time or until certain well pressures are reached before the well is then shut in again and the plunger falls, thereby restarting the cycle. This conventional run is more appropriate for weaker wells that require a shut in to build pressure.

In the case of stronger wells, especially those in the earlier portions of their life, it is undesirable to shut in the well and lose that production time, yet there is still a need to remove liquids from the well, and often the need for a plunger to run up and down the production string to keep it clean. Thus there is a need for a plunger lift system that can run without having to shut in the well, and a plunger that is able to fall against the flow rising in the production string. This need has been the driving force in the development of bypass plungers and other continuous run plungers that are able to fall against the flow and lift liquid to the surface. This is made possible by the plunger having two configurations: one for falling through flow and one for lifting a liquid load, with the former having a low resistance to flow and the latter having a much higher resistance to flow.

BRIEF SUMMARY OF THE INVENTION

The present invention relates to a plunger which is utilized to travel within an oil or gas hydrocarbon recovery system to enable efficient recovery of liquids therefrom which would otherwise not normally have been so enabled. The oil and gas recovery system utilized in the present invention comprises an above ground wellhead complex comprised of an inner tubing which extends into the ground and is surrounded longitudinally by an outer casing into the lower well formation therebeneath.

The above ground wellhead complex comprises a system of conduits for receiving a plunger thereat, by an impact damping spring at its bottom end, and a sales line at its upper end, for withdrawal of collected hydrocarbon fluid which is controlled through a major valve within that sales line. An inner tubing extends from the ground level into a hydrocarbon formation within the earth. The inner tubing is surrounded by an outer casing. The outer casing has a plurality of perforations at its lower end to receive hydrocarbon fluids therein, under pressure, for receipt within the outer casing and within the lower portion of the inner tubing.

An impact damping lower bumper, referred to as a bumper spring, is arranged at the bottom of the inner tubing. The bumper spring permits hydrocarbon fluids to be received and drawn through into the lower portion of the inner tubing.

The plunger aspect of the present invention comprises an elongated sleeve with an internal "plug" that functions as a ball and seat valve arrangement which is open during the fall of the plunger within the inner tubing, allowing a flow of fluid through the plunger, thus giving the plunger the ability to fall while the well is flowing; and which ball and seat valve arrangement is closed during the rise of the plunger from the well bottom, restricting all fluid therethrough, thus completely blocking flow through the plunger, giving you the ability to effectively harness the well's energy to lift the liquid out of the well bore.

In one aspect of the present invention, the plunger assembly comprises an elongated sleeve having an upper end and a lower end with a longitudinally displaceable plug arranged therewithin. The lower end of the sleeve has a narrowed conduit extending longitudinally therethrough, opening up via an inclined or tapered annular surface, which defines a lower "seat" into a larger diameter central chamber longitudinally directed therethrough, and having an upper end comprising a tapered or conically shaped annular surface comprising an upper "seat" extending into a narrowed neck which extends upwardly into a larger diameter upper conduit having an open upper end at the upper end of the plunger assembly.

A longitudinally displaceable plug is arranged within the elongated central chamber of the sleeve. The plug, in a first embodiment thereof may be of round configuration, having a clearance between the outer surface thereof and the inner surface of the elongated central chamber. The plug in this embodiment is arranged to be disengaged from the receipt during the fall from the wellhead to the bumper spring, allowing a flow through the plunger, and nestled into through-flow blocking or restricting configuration against the upper seat during its rise from the bumper spring to the wellhead by virtue of the pressure gradient across the plug, with the higher pressure below the plunger, forcing the assembly upward and effecting an upward force on the plug, into nestling into snug receipt within the sleeve of the plunger throughout the rising portion of the plunger's cycle. The plug may for example, have alternate configurations such as being of teardrop shape or cylindrical shape.

The plunger assembly in a further aspect of the invention may be utilized with an arrangement of passageways through both the plug and through the sidewalls of the sleeve of the plunger. The plug in this particular embodiment may be of generally elongated cylindrical form having at least three elongated radially directed wings extending therealong, in one preferred embodiment, arranged parallel to one another. This elongated plug in this embodiment may preferably have a central bore extending longitudinally therethrough to allow a certain restricted amount of flow through the plunger during its rising portion of the cycle. The upper and lower ends of the plug may be conically shaped or with a hemispherical shape, to allow the plug to nest snugly within correspondingly shaped upper and lower seats of the elongated central chamber of the sleeve.

A further aspect of the plunger arrangement utilized with the elongated plug comprises a plurality of longitudinally directed vents extending through the sidewall of the sleeve of the plunger to enhance flow through the plunger or bias the position of the plug within the sleeve or to manipulate the sensitivity of the position of the plug to changes in plunger velocity or density and composition of fluid encountered in the inner tubing.

A still further aspect of the plunger arrangement comprises a plurality of circumferentially disposed longitudinally directed conduits disposed through the lower seat of the elongated sleeve, reducing flow restriction through the lower seat while maintaining the ability of the sleeve to retain a plug of a given size. Further aspects of this plunger assembly include an array of circumferentially disposed angular grooves to effect rotation of the plunger about its longitudinal axis as it traverses the inner tubing of the oil and gas well assembly preventing uneven wear of the outer surface of the sleeve and enhancing the turbulent seal effect. Another aspect of the plunger assembly includes a plurality of tangentially directed exit holes through the sidewall of the sleeve of the plunger assembly to facilitate and encourage further rotation of that plunger assembly about its longitudinal axis during its travel through the inner tubing. A yet further aspect of the plunger assembly includes a plurality of longitudinally distributed annular seal grooves cut into the outer surface of the sleeve of the plunger assembly so as to effect a turbulence-seal that harnesses the flow of energy to be used in lifting the plunger and liquid load to the surface.

In yet a further aspect of the plunger assembly, the elongated central chamber may be of variable inner diameter so as to bias the position of the plug during fall of the plunger, and to manipulate the sensitivity of the position of the plug to changes in flow conditions. One example is an inner chamber with a conical shape with its larger diameter disposed towards the upper end of the plunger assembly, this configuration would decrease the flow velocity through the sleeve near the upper end thereof, ensuring that the plug would not prematurely fully engage the upper seat.

In another aspect of the plunger assembly, magnets may be utilized to bias the position of the plug and manipulate the sensitivity of the position of the plug to changes in flow conditions. One or more annular magnets may be present within the sleeve, such as for example, one magnet positioned just above the lower seat to retain the plug in the lowest portion of the elongated central chamber of the sleeve during its fall.

In still yet another aspect of the present invention, the elongated central chamber may be of slightly conical configuration with its larger diameter being towards the upper end of the plunger assembly. The plug arranged within that elongated central chamber may be of a drag inducing shape so as to induce movement of that plug within the elongated chamber depending upon the direction of motion of the plunger assembly either going upwardly or downwardly within the inner casing and enhance the ability of the plug to become nestled into the upper seat of the sleeve and initiate the "rising portion" of the plunger cycle upon reaching the bumper spring. Such a drag inducing shape may consist of a blunt or flat lower end and an annular lip adjacent its upper end with a conical surface along its upper end above that annular lip.

The invention thus comprises a plunger assembly vertically movable within an inner tubing of a gas well system, for the enabling of hydrocarbon fluid extraction from such gas well system, the plunger assembly comprising: an elongated plunger sleeve having a longitudinally arranged elongated bore extending therethrough; a plug movably arranged within an elongated central chamber within the elongated bore of the plunger sleeve, wherein the plug is arranged to displaceably move within the central chamber and to nest within an upper end of the central chamber during upward travel of the plunger in the inner tubing, and the plug is arranged to float within the central chamber during downward travel of the plunger in the inner tubing of the gas well system, to effect flow of hydrocarbon fluids therethrough so as to enable hydrocarbon fluid to be recovered from a gas well system. The plug may be of spherical shape. The plug may be of cylindrical shape. The cylindrically shaped plug may have elongated wings on an outer surface thereof. The cylindrically shaped plug may have a longitudinally directed bore extending therethrough. The elongated central chamber preferably has a plug conforming seat arranged at each end thereof. The elongated sleeve may have an arrangement of plug-position-controlling magnets therein. The elongated sleeve may have a plurality of ports arranged through a sidewall thereof. The plurality of ports are preferably arranged tangentially with respect to the elongated sleeve. The plurality of ports may be of longitudinally elongated configuration.

The invention also comprises a method of extracting hydrocarbon fluids from a gas well system comprising the steps of: forming an elongated plunger with an elongated bore extending longitudinally therethrough; arranging a plug-containing central chamber within the elongated bore; placing a plug within the plug containing central chamber wherein the plug is movable longitudinally within the central chamber; placing the plug containing plunger in an inner tubing a gas well system; dropping the plug containing plunger in the inner tubing of the gas well system; enabling the plug to move to an upper seat engaging position in the central chamber; and pushing a slug of hydrocarbon fluid upwardly within the inner tubing ahead of the plunger as the plunger moves upwardly within the inner tubing of the gas well system. The method may include: moving the plug from a sealing-nesting-engagement with the upper end of the central chamber when the plunger travels in a downward direction, wherein fluid is arranged to flow through the elongated bore of the plunger during movement of the plunger through the inner tubing, and wherein fluid may be restricted from flowing through the plunger during upward travel of the plunger within the inner tubing of the gas well system.

The invention also comprises a plunger for extraction of hydrocarbon fluids from a gas well system wherein the plunger is arranged to move upwardly and downwardly in an arrangement of inner tubing within the gas well system, the plunger comprising: an elongated housing sleeve having a longitudinally directed bore; an elongated central chamber within the longitudinally directed bore, the central chamber having a plug nestable seat at each end thereof; and a plug displacably arranged within the central chamber so as to seal the bore during travel of the plug in a first direction in the inner tubing, and to permit flow of fluid through the plunger as the plunger travels in a second direction in the inner tubing. The central chamber may be of varying cross sectional dimension. The plunger may have secondary conduits extending from the central chamber to a location outside of the plunger. The secondary conduits may extend from a seat at one end of the central chamber. The secondary conduits may extend through a side wall of the central chamber.

BRIEF DESCRIPTION OF THE DRAWINGS

The objects and advantages of the present invention will become more apparent, when viewed in conjunction with the following drawings in which.

DETAILED DESCRIPTION OF THE PRESENT INVENTION

Figure 1:
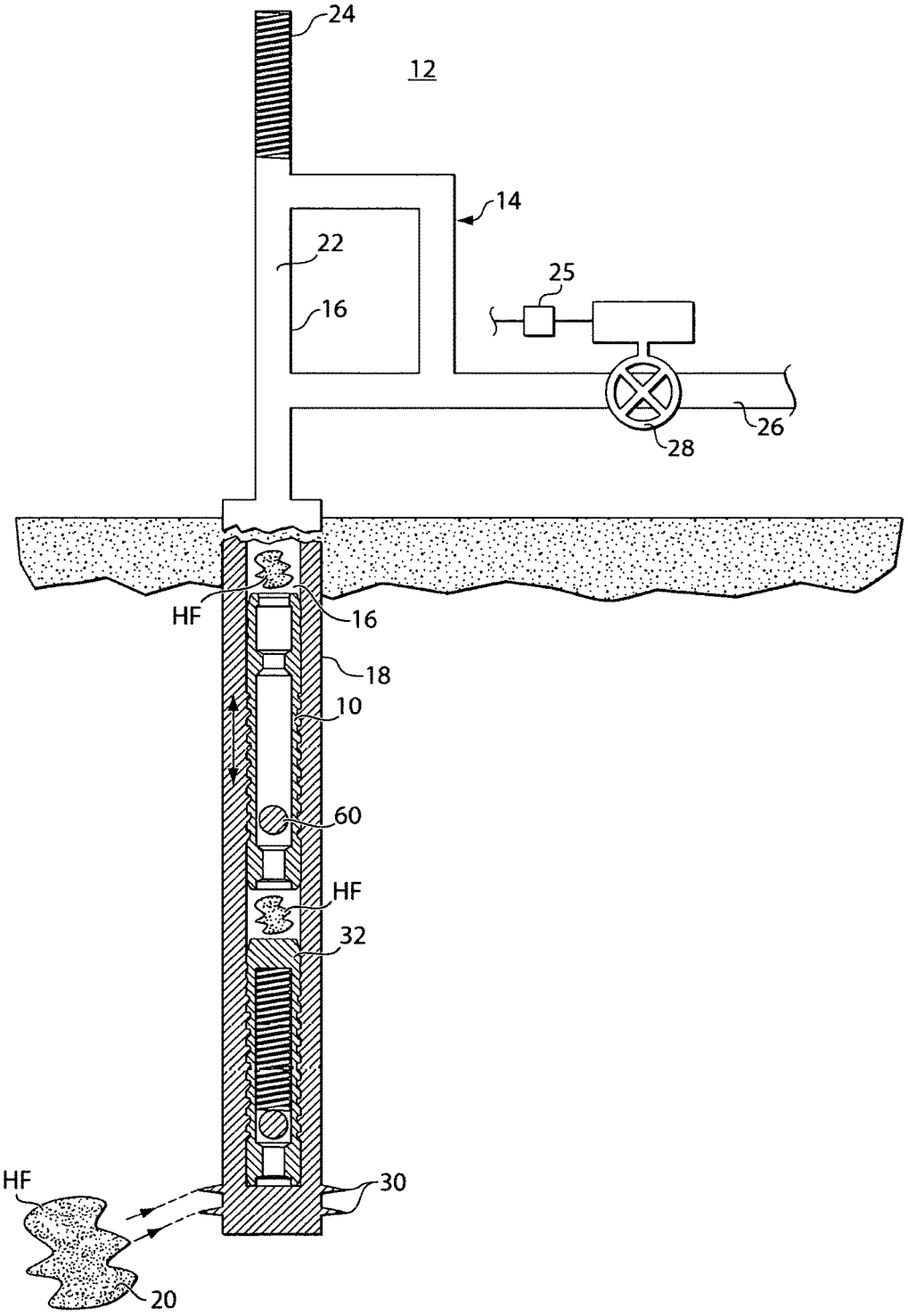
FIG. 1 is a schematic representation of a oil and gas well hydrocarbon recovery arrangement.

The present invention relates to a plunger/plunger assembly 10 which is utilized to travel within a gas or gassy oil well system 12 as represented in FIG. 1, to enable efficient recovery of liquids therefrom which would otherwise not normally have been captured. The gas well system 12 utilized in the present invention comprises an above ground wellhead complex 14 comprised of an inner tubing 16 which extends into the ground and is surrounded longitudinally by an outer casing 18 into the lower well formation 20 therebeneath. The above ground wellhead complex 14 comprises a system of conduits 22 for receiving and capturing the plunger 10 thereat by an upper impact damping spring 24 and a sales line 26 for withdrawal of collected hydrocarbon fluid which sales line 26 is controlled via a proper computerized fluid control circuit 25 through a meter valve 28 within that sales line 26. The inner tubing 16 extends from the ground level into the hydrocarbon formation 20 within the earth. The inner tubing 16 is surrounded by the outer casing 18. The outer casing 18 has a plurality of perforations 30 to receive hydrocarbon fluids I-IF under pressure for receipt within the outer casing 18 and also within the lower portion of the inner tubing 16, as represented in FIG. 1.

A lower bumper spring 32, shown in FIG. 1, is arranged at the bottom of the inner casing 16. The bumper spring 32, in one function thereof, permits hydrocarbon fluids HF to be received and drawn through the perforations 30 and hence into the lower portion of the inner tubing 16.

Figure 2:
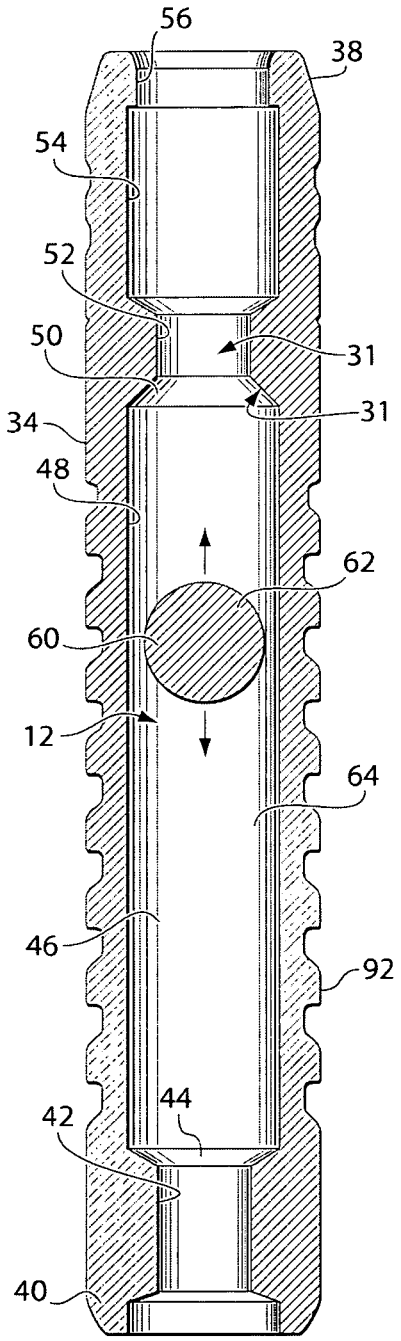
FIG. 2 is a longitudinal sectional view of a first embodiment of a plunger assembly with the associated sleeve and plug constructed according to the principles of the present invention.

The plunger 10 in one preferred aspect of the present invention, as represented in FIG. 2 comprises an elongated sleeve 34 with a plug 60 therein, which plug 60, in this embodiment is of spherical shape, and may be freely disposed within the sleeve 34 to permit flow of fluid through the plunger 10 during the falling portion of the plunger cycle, or engaged within an upper seat 31 of an elongated central inner chamber 46 within the sleeve 34, so as to restrict flow of fluid through the plunger 10 during the rising portion of the plunger's cycle within the well system 12.

In one aspect of the present invention, the plunger assembly 10 comprises the elongated sleeve 34 having an upper end 38 and a lower end 40, as represented in FIG. 2. The lower end 40 has a narrowed lower conduit 42 extending longitudinally therethrough opening up into the central chamber 46, via an inclined or tapered annular surface 44, which defines a lower "seat" into a larger diameter central chamber 46 longitudinally directed therethrough. The elongated central chamber 46 has an upper end 48 having a tapered, conically or arcuately shaped annular surface 50 extending into a narrowed neck 52 which narrowed neck 52 extends upwardly into a larger diameter upper conduit 54, which upper conduit 54 has an opening 56 at the upper end 38 of the plunger assembly 10. The curved and shaped annular surface 50 at the upper end comprises an "upper" seat in which a plug 60 would compressedly nest as the plunger travels upwardly towards the well head 14.

The plug 60 is longitudinally displaceable within the elongated central chamber 46. The plug 60, in a first embodiment thereof as represented in FIG. 2, may in one preferred embodiment thereof, be of round configuration, having a clearance between its outer surface 62 thereof and the inner surface 64 of the elongated central chamber 46, allowing flow of fluid through the central chamber 46 only during the time the plug 60 is disengaged and displaced from its snug engagement with the upper seat 50. The plug 60 in this embodiment is thus arranged to be nestled into hydrocarbon fluid blocking configuration against the upper seat 50 by virtue of hydrocarbon fluid pressure from the lowest portion of the inner tubing and casing 16 and 18, effecting that pressure thereagainst, during the travel of the plunger assembly 10 upwardly within the inner tubing 16 within the casing 18. The plug assembly 60 may for example, have alternate configurations such as being of teardrop shape or cylindrical shape.

The operation of the plunger 10 within the gas well system 12 is arranged so as to enable the plunger 10 to follow upwardly through the inner tubing 16 while the valve 28 is open and the well is flowing by virtue of the plug 36 suspended freely within the central chamber 46 of the sleeve 34, such that the plunger 10 is able to act as a tightly sealing piston within the inner tubing 16 while thus lifting a liquid load upwardly from the bumper spring 32 to the wellhead 14 by virtue of the plug 36 being pressurizably nestled against the upper seat 50 of the sleeve 34.

The relative forces on the sleeve 34 and the plug 36 during fall of the plunger 10 within the inner tubing 16 imparts an upward drag force on the sleeve 34 which force is not experienced by the plug 36, allowing the plug 36 to become/remain disengaged from the upper seat 50 of the sleeve 34, with the flow through the inner chamber 46 of the sleeve 34 preventing the plug 36 from nestably engaging in the lowest seat 44.

When the plug 10 reaches the lower bumper spring 32, the fluid flow complete, thus eliminating the upper drag force imparted on the sleeve 34 by the inner tubing 16, allowing the rising portion of the plunger 10 travel cycle to be initiated in which the inner tubing 16 imparts a downward drag force on the sleeve 34 that is not experienced by the plug 36, while a pressure gradient directed flow upwardly allows the plug 36 to accelerate upwardly relative to the sleeve 34, thus engaging the plug 36 within the upper seat 50 of the sleeve 34. This rising configuration is maintained while the plunger 10 lifts liquid thereabove, to the wellhead complex 14 by virtue of the pressure gradient in which pressure is higher beneath the plunger 10. Upon striking the impact damping upper spring 24 in the wellhead 14, the plunger 10 is no longer rising, and the falling configuration is initiated.

The plunger assembly 10, in a further aspect of the invention may be utilized with an arrangement of passageways through the plug 60 and/or through the sidewalls of the sleeve 34 of the plunger assembly 10, as represented in FIGS. 3, 4, 5 and 6. The plug 60 in this particular embodiment shown in FIG. 3, may be of generally elongated cylindrical form having at least three elongated radially directed wings 70 extending therealong, preferably parallel to one another. The elongated plug 60 in this embodiment may have a central bore 72 extending longitudinally therethrough. This elongated plug 60 will have an upper-seat-engaging upper end 74 of truncated conical configuration. This elongated plug 60 will have a lower end 76 of similar truncated conical configuration. The conical configuration on both the upper and lower end 74 and 76 of this elongated plug 60 is arranged to snugly nest within the upper and the lower seats 50 and 44 at their respective ends of the elongated central chamber 46 of the plunger 10 configured therewith.

Figure 3:
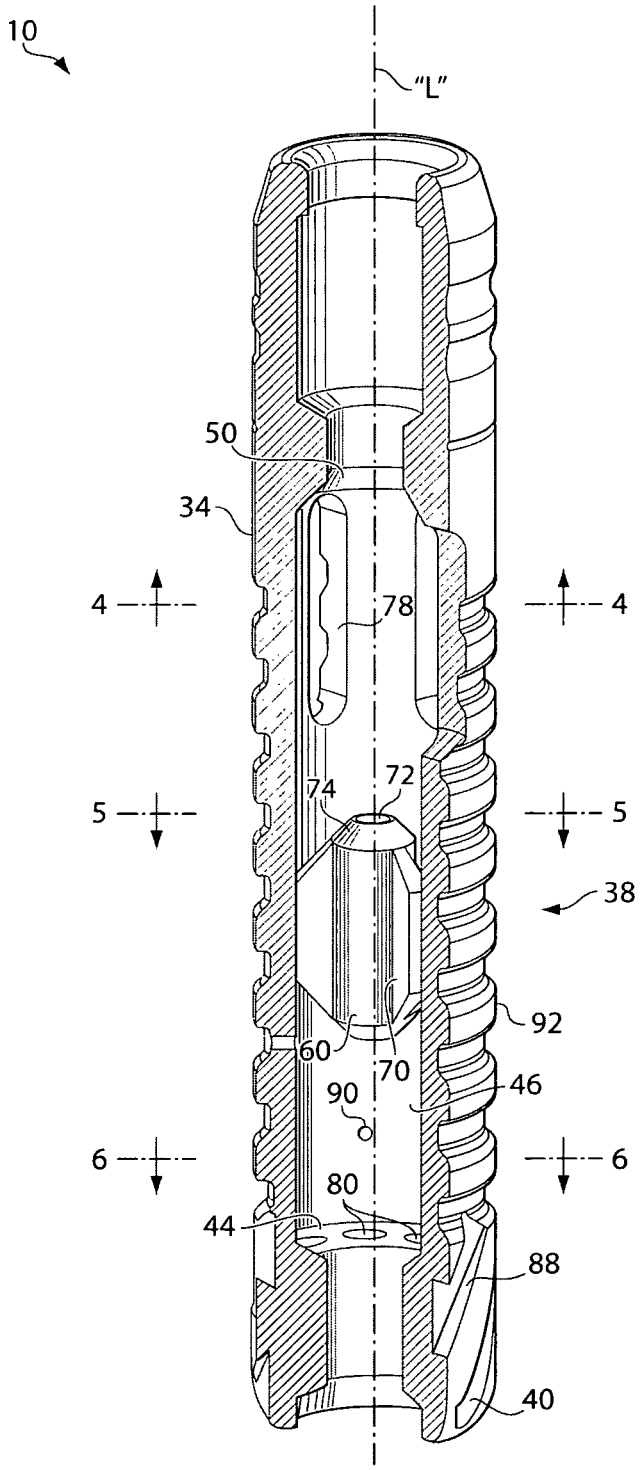
FIG. 3 is a longitudinal sectional view of a further embodiment of the plunger assembly and associated sleeve and plug constructed according to the principles of the present invention.
Figure 4:
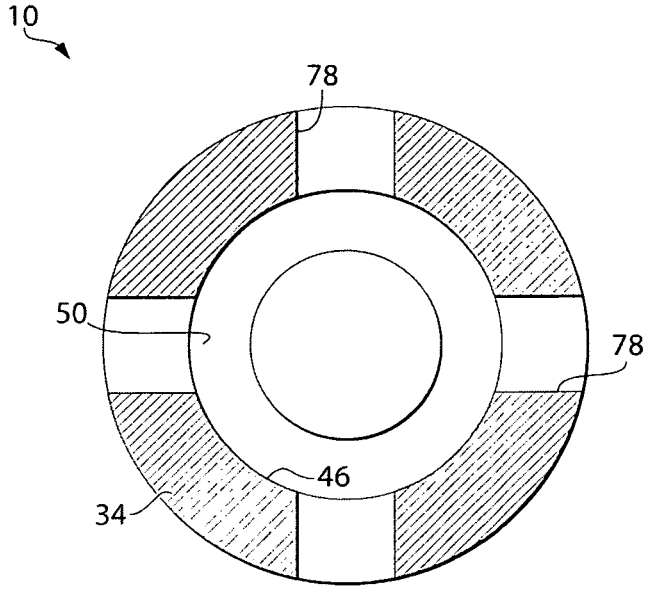
FIG. 4 is a view taken along the lines 4-4 of FIG. 3.
Figure 5:
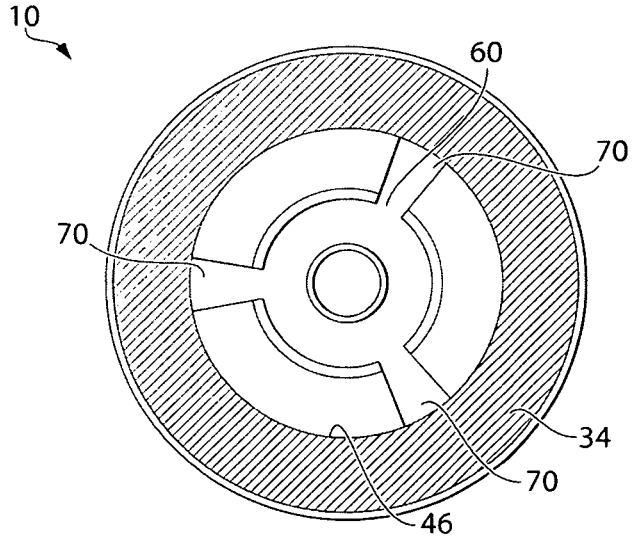
FIG. 5 is a view taken along the lines 5-5 of FIG. 3.

A further aspect of the plunger arrangement 10, as shown in FIG. 3, is utilized with the elongated plunger sleeve 34 includes a plurality of longitudinally directed vents 78 extending through the sidewall of that sleeve 34 of the plunger 10 at the upper end of its central chamber 46. The vents 78 may be arranged to bias the position of a plug 60 within the central chamber 46 during the falling portion of the plunger lift cycle.

Figure 6:
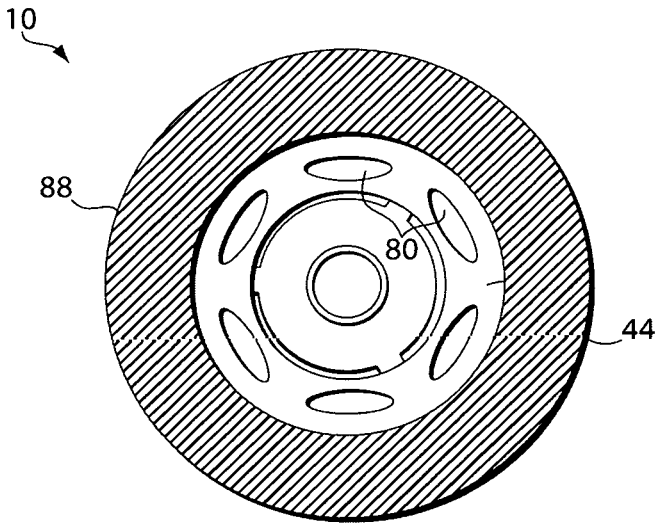
FIG. 6 is a view taken along the lines 6-6 FIG. 3.

A still further aspect of the plunger arrangement 10 utilized with an embodiment of the elongated plug 60 comprises a plurality of circumferentially disposed longitudinally directed secondary conduits 80, as shown in FIG. 3, disposed through the lower seat surface 44 adjacent to the lower entry opening 82, which conduits 80 are extend through and are open at the lower end 40 of the plunger assembly 10, the conduits 80 shown also in FIG. 6.

Further aspects of this plunger assembly 10 include an array of circumferentially disposed angular grooves 88 to effect rotation of the plunger assembly 10 about its longitudinal axis "L" as it traverses the inner tubing of the gas well as to minimize uneven wear from occurring on the sleeve 34.

Another aspect of the plunger assembly 10 includes a plurality of tangentially directed exit holes 90, through the sidewall of the sleeve 34 of the plunger assembly 10, shown in FIG. 3, to facilitate and encourage further rotation of that plunger assembly 10 about its longitudinal axis "L" during its travel through the inner tubing 16.

A yet further aspect of the plunger assembly includes a plurality of longitudinally distributed annular seal grooves 92 cut into the outer surface of the sleeve 34 of the plunger assembly 10, as shown in FIGS. 2 and 3, so as to effect a fluid turbulence-generating and cleansing effect by the plunger assembly 10 of the hydrocarbon fluid HF theresurrounding, during the plunger's travel through the inner casing 16.

Figure 7:
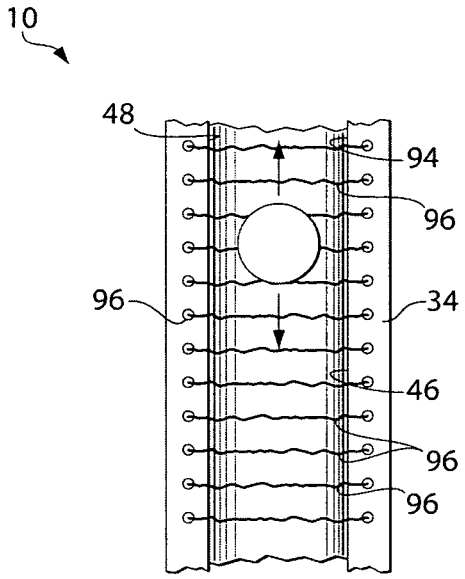
FIG. 7 is a cross-sectional view of a further embodiment of the plunger assembly and plug the within.

In yet a further aspect of the plunger assembly 10, as represented in FIG. 7, the elongated central chamber 46 may be of slightly tapered conical configuration with its larger diameter 94 being towards the upper end of the plunger 10 so as to bias the position of the plug 60 during the fall of the plunger and manipulate the sensitivity of the position of the plugs 62 changes in flow conditions.

In another aspect of the plunger 10, one or more aligned, controllable magnets 96 may be utilized to bias the position of the plug 60 within the central chamber 46, the magnets 96 also serving the purpose of maintaining the desired position of the plug 60, which may be magnetically attractable, during events such as the plunger 10 running through a slug of liquid in tubing 16, while the plunger 10 is falling.

Figure 8:
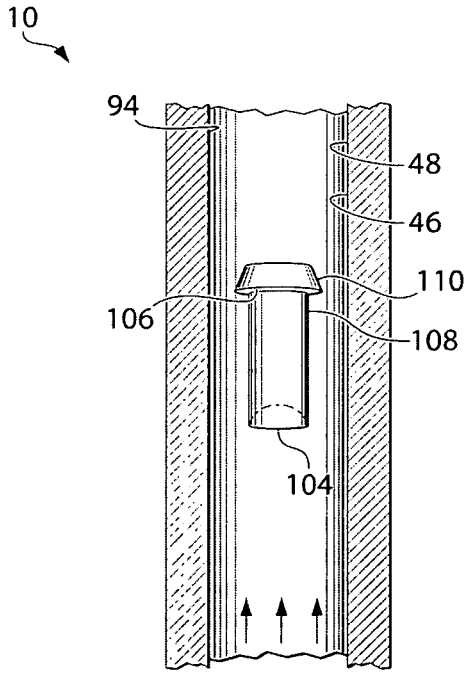
FIG. 8 is a cross sectional view of yet a further embodiment of the plunger assembly and plug there within constructed according to the principles of the present invention.

In still yet another aspect of the present invention, the elongated central chamber 46, as represented in FIG. 8, may be of slightly conical configuration with its larger diameter 94 being towards the upper end 48 of the plunger assembly 10. The plug 60 of this embodiment, shown disposed within that elongated central chamber 46, may be of a drag inducing shape so as to facilitate movement of that plug 60 within the elongated chamber 46 towards the upper seat 50, so as to promptly initiate a rising configuration of the plug 60 upon the plunger 10 reaching the lower bumper spring 32 at the completion of falling. Such a drag inducing shape may for example, consist of a blunt or flat lower end 104 and an annular lip 106 adjacent its upper end 108 with a truncated conical surface 110 along its upper end above that annular lip 106.

Thus, the present invention comprises a sleeve 34 and a plug 60 retained within the sleeve 34, wherein the flow through the plunger 10 is permitted during the plunger's fall and restricted during the plunger's rise, allowing the plunger 10 to be operated in a continuous cyclically-run power-free fashion.

The invention claimed is:

1. A plunger assembly vertically movable within an inner tubing of a gas well system, for the enabling of hydrocarbon fluid extraction from such gas well system, the plunger assembly comprising:

an elongated plunger sleeve having a longitudinally arranged elongated central chamber extending therethrough;

a cylindrically shaped plug with a longitudinally directed bore extending therethrough is movably arranged within the elongated central chamber of the plunger sleeve, wherein the plug is arranged to displaceably move within the elongated central chamber and to nest within an upper end of the central chamber during upward travel of the plunger assembly in the inner tubing, and wherein the plug is movable within the central chamber during downward travel of the plunger assembly in the inner tubing of the gas well system, to effect flow of hydrocarbon fluids therethrough so as to enable hydrocarbon fluid to be recovered from a gas well system.

2. The plunger assembly as recited in claim 1, wherein the cylindrically shaped plug has longitudinally directed elongated wings on an outer surface thereof.

3. The plunger assembly as recited in claim 1, wherein the elongated central chamber has a plug conforming seat arranged at each end thereof.

4. The plunger assembly as recited in claim 3, wherein the elongated central chamber has an arrangement of plug-position-controlling magnets therein.

5. The plunger assembly as recited in claim 1, wherein the elongated plunger sleeve has a plurality of ports arranged through a sidewall thereof.

6. The plunger assembly as recited in claim 5, wherein the plurality of ports are arranged tangentially with respect to the elongated plunger sleeve.

7. The plunger assembly as recited in claim 5, wherein the plurality of ports are of longitudinally elongated configuration.

8. A method of extracting hydrocarbon fluids from an inner tubing lining a gas well system comprising the steps of:

forming an elongated plunger with an elongated central chamber extending longitudinally therethrough;

arranging an elongated cylindrically-shaped plug with a bore extending therethrough, within the elongated central chamber wherein the plug is movable longitudinally within the elongated central chamber;

arranging the plug containing plunger in the inner tubing lining the gas well system;

dropping the plug containing plunger in the inner tubing of the gas well system;

enabling the plug to move to an upper seat engaging position in the elongated central chamber; and pushing a slug of hydrocarbon fluid upwardly within the inner tubing ahead of the plunger as the plunger moves upwardly within the inner tubing lining the gas well system.

9. The method as recited in claim 8, including:

moving the plug from a sealing-nesting-engagement with the upper end of the central chamber when the plunger travels in a downward direction.

10. The method as recited in claim 8, wherein fluid is arranged to flow through the elongated bore of the plunger during movement of the plunger through the inner tubing.

11. The method as recited in claim 8, wherein fluid is restricted from flowing through the plunger during upward travel of the plunger within the inner tubing of the gas well system.

12. A plunger for extraction of hydrocarbon fluids from a gas well system wherein the plunger is arranged to move upwardly and downwardly in an arrangement of inner tubing within the gas well system, the plunger comprising:

an elongated housing sleeve having a longitudinally directed elongated central chamber therethrough, wherein the elongated central chamber has a plug nestable seat at each end thereof; and an elongated cylindrically-shaped plug with a bore extending therethrough and an arrangement of external, longitudinally-aligned wings thereon, displacably arranged within the elongated central chamber so as to move within the elongated central chamber of the plug during travel of the plug in a first direction in the inner tubing, and to permit flow of fluid through the plunger as the plunger travels in a second direction in the inner tubing.

13. The plunger as recited in claim 12, wherein the elongated sleeve has conduit portions of varying cross sectional dimension.

14. The plunger as recited in claim 12, wherein the elongated sleeve of the plunger has a plurality of exit holes extending from the elongated central chamber to a location outside of the elongated sleeve of the plunger.

15. The plunger as recited in claim 14, wherein the exit holes extend from a seat at one end of the central chamber.

16. The plunger as recited in claim 14, wherein the exit holes extend through a side wall of the central chamber.

* * * * *